US011255496B2

(12) United States Patent
Labas

(10) Patent No.: US 11,255,496 B2
(45) Date of Patent: Feb. 22, 2022

(54) LIGHTING DEVICE COMPRISING LEDS AND REFLECTION ELEMENT

(71) Applicant: Lumileds LLC, San Jose, CA (US)

(72) Inventor: Danijel Labas, Baesweiler (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/514,425

(22) Filed: Jul. 17, 2019

(65) Prior Publication Data

US 2020/0025343 A1 Jan. 23, 2020

(30) Foreign Application Priority Data

Jul. 17, 2018 (EP) ..... 18183867

(51) Int. Cl.

| | |
|---|---|
| ***F21S 4/24*** | (2016.01) |
| ***F21V 3/02*** | (2006.01) |
| ***F21V 7/00*** | (2006.01) |
| ***F21V 23/06*** | (2006.01) |
| *F21Y 103/10* | (2016.01) |
| *F21Y 115/10* | (2016.01) |
| *F21W 106/00* | (2018.01) |

(52) U.S. Cl.

CPC *F21S 4/24* (2016.01); *F21V 3/02* (2013.01); *F21V 7/00* (2013.01); *F21V 23/06* (2013.01); *F21W 2106/00* (2018.01); *F21Y 2103/10* (2016.08); *F21Y 2115/10* (2016.08)

(58) Field of Classification Search

CPC ..... F21S 4/24; F21S 4/22; F21V 3/02; F21V 7/005; F21V 23/06

See application file for complete search history.

(56) References Cited

U.S. PATENT DOCUMENTS

| | | | | |
|---|---|---|---|---|
| 6,074,074 A * | 6/2000 | Marcus | B29C 45/14655 362/240 |
| 6,354,714 B1 * | 3/2002 | Rhodes | B64F 1/20 362/145 |
| 8,167,476 B2 | 5/2012 | Sakamoto et al. | |
| 10,520,143 B1 * | 12/2019 | Findlay | F21S 4/22 |

(Continued)

FOREIGN PATENT DOCUMENTS

| | | |
|---|---|---|
| JP | 3200708 U | 10/2015 |
| KR | 20110129273 | 12/2011 |
| WO | 2017/153216 A1 | 9/2017 |

*Primary Examiner* — Bryon T Gyllstrom
*Assistant Examiner* — Christopher E Dunay
(74) *Attorney, Agent, or Firm* — Volpe Koenig

(57) ABSTRACT

A lighting device, wherein the effectivity is increased and allows maintaining a simple manufacturing process, comprises: a housing having a longitudinal direction, the housing comprising: reflective side walls extending in the longitudinal direction, a first cavity disposed between the reflective side walls, and an opening of the first cavity for the passage of light from the first cavity; LEDs, each having a light-emitting face and side faces, wherein the LEDs are arranged on interposers for providing electrical connection of the LEDs, wherein the LEDs are arranged in the first cavity such that the LEDs are at least partially arranged along the longitudinal direction of the housing; and a reflection element that covers a side of the interposers facing the opening, wherein the reflection element surrounds the LEDs on the side faces, and is configured as strip comprising through holes in which the LEDs are arranged.

18 Claims, 3 Drawing Sheets

(56) References Cited

U.S. PATENT DOCUMENTS

2003/0193803 A1* 10/2003 Lin ..... F21S 4/24 362/249.04
2004/0022061 A1* 2/2004 Shih ..... B60Q 1/2665 362/396
2004/0168359 A1* 9/2004 Cleaver ..... F21K 9/00 40/547
2005/0092517 A1* 5/2005 Fan ..... F21S 4/24 174/117 FF
2008/0137332 A1* 6/2008 Lo ..... F21S 4/24 362/240
2010/0103654 A1 4/2010 Yasuda et al.
2011/0188248 A1* 8/2011 Chang ..... F21V 19/0015 362/249.02
2012/0275157 A1* 11/2012 Hsu ..... F21S 4/22 362/249.06
2012/0326634 A1* 12/2012 Li ..... H05B 45/46 315/312
2013/0128555 A1* 5/2013 Brauser ..... A01K 27/006 362/108
2013/0188335 A1* 7/2013 Marche ..... F21S 9/02 362/103
2014/0036500 A1* 2/2014 Eggleton ..... F21V 31/00 362/235
2014/0104838 A1 4/2014 Reiss et al.
2014/0196284 A1* 7/2014 Volpato ..... F21S 4/22 362/368
2014/0334142 A1* 11/2014 Levante ..... F21V 23/06 362/222
2015/0145406 A1 5/2015 Li et al.
2015/0261076 A1 9/2015 Dijken et al.
2015/0276189 A1* 10/2015 Palfreyman ..... F21V 21/14 362/235
2015/0330584 A1* 11/2015 Bobbo ..... F21V 15/013 362/220
2015/0355398 A1* 12/2015 De Vaan ..... G02B 6/0018 362/217.05
2016/0076741 A1* 3/2016 Rong ..... F21V 7/0033 362/84
2016/0091178 A1* 3/2016 Alfier ..... F21V 3/0625 362/223
2016/0138768 A1* 5/2016 Greene ..... F21V 19/0025 362/249.04
2016/0281969 A1* 9/2016 Ishibashi ..... F21V 3/08
2016/0356454 A1* 12/2016 Camarota ..... F21V 7/005
2018/0017238 A1* 1/2018 Volpato ..... F21V 23/002
2018/0031190 A1* 2/2018 Nicolai ..... F21V 23/04
2018/0209591 A1* 7/2018 Reiss ..... F21V 31/04
2018/0245754 A1* 8/2018 Gensler ..... F21V 3/049
2018/0306413 A1* 10/2018 Tremaine ..... F21V 15/012
2019/0277461 A1* 9/2019 Monestier ..... G02B 6/0095
2019/0277463 A1* 9/2019 Santos ..... F21V 7/0008
2020/0088364 A1* 3/2020 Gielen ..... F21S 4/24

* cited by examiner

LIGHTING DEVICE COMPRISING LEDS AND REFLECTION ELEMENT

FIELD OF THE INVENTION

The present disclosure relates to flexible lighting devices comprising multiple light emitting diodes (LEDs) arranged along a longitudinal direction of a housing, wherein the lighting device comprises a reflection element.

BACKGROUND

LEDs or LED packages are typically provided with housings for protection and for controlling the shape of light emitted by the LEDs. Multiple LEDs may be arranged together in a single housing. The housing may for example have an elongated shape and may be similar in shape to a strip, with the LEDs being arranged along the length of the strip. The LEDs may therefore be assembled together with the housing basically as a semi-finished product in an "endless" or "one-dimensional" manner, significantly reducing production costs and allowing choosing the length of the lighting device. The housing may be based on flexible materials such as silicone that allow a flexing or bending of the lighting device. The lighting device may therefore be brought into a variety of shapes.

Besides the already mentioned protection of the LEDs by the housing, e.g. from mechanical impact or humidity, the housing may also be configured to increase the efficiency of the lighting device in that a large part of the emitted intensity is used for illumination. For instance, significant parts of the housing may be based on highly reflective material and/or comprise optical elements to allow for a reduction of light loss in the lighting device. In particular, to retain the flexible properties of the housing, in particular silicone with embedded reflective particles (so-called "white silicone") may be used.

For providing electrical connection to the LEDs, interposers can be provided. Interposers may for instance comprise a combination of electrical conductive and insulating elements, for example in a printed circuit board. Such interposers and are at least partially light absorbing. As the interposers are arranged very close to the LEDs, a significant light loss is caused by the absorption on the interposers. Further light loss may occur by absorption on other elements of the housing, for instance wires for electrical connection of the interposer.

A possibility to reduce this light loss is to fill a reflective material such as white silicone into the housing and around the interposer. However, it has been found that the filling of white silicone around the interposers is difficult, as a covering of the light-emitting faces of the LEDs by the reflective material needs to be avoided. Therefore, the amount of molded material needs to be restricted, which may lead to an incomplete covering of the interposers. The filling of reflective material therefore complicates the production of the lighting device, while the lighting effectivity is not fully optimized.

SUMMARY

It is an object of the present invention to provide a lighting device in particular having an elongated shape, wherein the effectivity of the lighting device is increased and allows maintaining a simple manufacturing process. The invention further relates to a method for producing such a lighting device and a use of such a lighting device based on the aforementioned object.

According to a first aspect of the present invention, a lighting device is provided, comprising: a housing having a longitudinal direction, the housing comprising: reflective side walls extending in the longitudinal direction, a first cavity disposed between the reflective side walls, and an opening of the first cavity for the passage of light from the first cavity; LEDs, each LED having a light-emitting face and side faces, wherein the LEDs are arranged on interposers for providing electrical connection of the LEDs, wherein the LEDs are arranged in the first cavity such that the LEDs are at least partially arranged along the longitudinal direction of the housing relative to each other; and a reflection element that covers a side of the interposers facing the opening, wherein the reflection element surrounds the LEDs on the side faces, wherein the reflection element is configured as strip comprising through holes in which the LEDs are disposed.

According to a second aspect of the present invention, a method for producing a lighting device is provided, in particular the lighting device according to the first aspect, the method comprising: providing a housing having a longitudinal direction, the housing comprising: reflective side walls extending in the longitudinal direction, a first cavity disposed between the reflective side walls, and an opening of the first cavity for the passage of light from the first cavity; providing LEDs, each LED having a light-emitting face and side faces, arranging the LEDs on interposers for providing electrical connection of the LEDs; arranging the LEDs in the first cavity such that the LEDs are at least partially arranged along the longitudinal direction of the housing relative to each other; and providing a reflection element to cover a side of the interposers facing the opening and to surround the LEDs on the side faces, wherein the reflection element is configured as strip comprising through holes in which the LEDs are arranged.

According to a third aspect of the present invention, a use of a lighting device according to the first aspect is provided in automotive lighting, in particular as automotive interior light.

Exemplary embodiments of the first, second and third aspect of the invention may have one or more of the properties described below.

The housing has a longitudinal direction, which in particular corresponds to the longest dimension (the length) of the housing. For instance, the housing may substantially comprise the shape of a strip. The housing may for example have given cross section, wherein the cross section is substantially the same along the length of the housing. The shape of a strip for the housing is in this context not limited to a (flat) strip with a rectangular cross section. The housing may rather also have a cross section with a profile different from a rectangle, e.g. a cross section with a U-shape or H-shape.

The housing comprises reflective side walls extending in the longitudinal direction with a first cavity disposed between the reflective side walls. The reflective side walls may each comprise a wall plane, wherein the longitudinal direction is substantially parallel to the wall plane. The reflective side walls may in particular be substantially parallel to each other. The first cavity is configured to receive the LEDs and in particular to accommodate the LEDs or LED packages completely, such that the LEDs may be arranged completely inside the housing to ensure mechanical protection. An opening of the first cavity for the passage of light from the first cavity is provided, which may be for instance be an opening between the reflective walls, i.e. the reflective walls for example do not enclose the cavity from all sides. The opening may be configured for a certain desired illumination pattern of the lighting device. The opening may for instance resemble a slit that is directed parallel along the longitudinal direction of the housing. The first cavity may be delimited by a rear wall of the housing which rear wall is arranged opposite to the opening.

Each LED has a light-emitting face and side faces, e.g. with an LED having a flat shape with one of the large surfaces being the light-emitting face. The LEDs may comprise at least one semiconductor element such as a p-n-junction, a diode, and/or a transistor. The LEDs may be provided as LED packages, for example in conjunction with a substrate, lead frame and/or wire bond(s). The LEDs may be configured as LED packages, which may be formed as an assembly comprising at least one LED chip and contacts for the LED.

The LEDs are arranged on interposers for providing electrical connection of the LEDs. The interposers are in particular configured as printed circuit boards that allow for an electrical interface routing from connection elements, such as wires, to the LEDs to provide the LEDs with electrical power. For instance, the interposer may comprise a flat or board-like shape with a flat-shaped LED or LED package arranged with the side opposite to the light-emitting face on the interposer. In particular, the interposer may have larger dimensions than the LED, such that the interposer projects from beneath the side faces of the LED.

In an embodiment of the lighting device, an interposer is provided for each LED, i.e. each LED is arranged on a separate interposer, wherein the interposers may be spaced apart from each other. In particular in combination with a housing comprising flexible material, the separate interposers allow for a flexibility of the lighting device, wherein the lighting device may be flexed or bent in between the more rigid interposers.

The LEDs are arranged in the first cavity. In particular, the LEDs are arranged in the first cavity with the light-emitting faces facing the opening of the housing. The LEDs are at least partially arranged along the longitudinal direction of the housing relative to each other. The LEDs may for example be arranged in intervals along the longitudinal direction of the housing, e.g. in regular or irregular intervals.

A reflection element is provided to prevent light loss in the housing of the LED, in particular light loss based on absorption in the interposers. The reflection element may cover a side of the interposers facing the opening, therefore reflecting light emitted from the LEDs before the light reaches the interposer. As the reflection element surrounds the LEDs on the side faces, the reflection element effectively covers the surface of the side of the interposers. In particular, the reflection element abuts to the side faces of the LEDs. The LEDs may engage with the through holes of the reflection element in a form fit.

The reflection element is configured as strip comprising through holes in which the LEDs are arranged. The reflection element in particular has a shape of a flat strip, wherein the cross section of the strip is substantially rectangular (with the exception of the through holes). Using a reflection element configured as a strip has the advantage that the reflection element can be provided in a particular simple manner, e.g. by providing a strip of reflective material and introducing the through holes into the strip by processes such as punching and/or cutting. The reflection element is therefore easier to provide than a molding of the interposers with reflective material, wherein care has to be taken not to block the light-emitting face of the LEDs, while it can be ensured that the side of the interposer is covered to an optimal extent.

Further, an undesired covering and blocking of the light-emitting face of the LEDs and therefore a loss in light intensity can effectively be avoided by choosing an appropriate thickness of the strip-shaped reflection element in view of the thickness of the LEDs on the interposers. In some embodiments, the thickness of the reflection element substantially corresponds to the thickness of the LEDs, such that the side faces of the LED are covered substantially entirely by the reflection element. In other embodiments, the thickness of the reflection element is larger than the thickness of the LEDs, which may be used to control the shape of the emitted light by means of the reflection element.

In an exemplary embodiment of the invention, the reflection element is formed integrally with the reflecting side walls. The reflection element may be arranged between the reflective side walls and extend from one reflective side wall to the another reflective side wall. For instance, the housing may comprise a cross section or profile that substantially corresponds to an H-shape or an A-shape. Under "formed integrally" may be understood that the reflection element and the reflecting side walls form a single component, in particular by material bonding. Integrating the reflection element with the reflecting side walls may simplify the production process, as the reflection element and the reflecting side walls can be manufactured simultaneously in a single production step.

In another exemplary embodiment of the invention, the reflection element is formed as a separate element from the remaining elements of the housing. This allows for instance to use a different type of material for the reflection element. In an embodiment of the lighting device, the reflection element is configured as a cover strip with through holes for the LEDs, which through holes are in particular punched and/or cut into the cover strip. Hence, already available semi-finished products may be used as reflection element, simplifying the production process. The cover strip may in particular be attached to the interposers by a form fit to the LED, by an adhesive and/or by filling the first cavity with a filler material, while the reflective strip are arranged on the interposers.

In another exemplary embodiment of the invention, the first cavity is at least partially filled with a transparent filler material. The transparent filler material is in particular based on silicone to provide flexible properties to the housing while ensuring a high transparency for the light emitted by the LEDs. The transparent filler material may be dispensed into the first cavity through the opening by injecting and curing the filler material. The transparent filler material may in particular embed the LEDs and/or the reflection element for an effective protection, e.g. against mechanical impact or humidity. At the same time, the transparent filler material may provide improved heat conduction from the LEDs and/or the interposers to the periphery of the housing to avoid an overheating of the LEDs during operation.

In an exemplary embodiment of the invention, a second cavity is formed between the reflecting side walls and the reflection element, wherein the interposers are arranged in the second cavity. In particular, the reflection element may be considered to divide a cavity formed between the reflective walls of the housing into a first cavity with an opening for the passage of light and a second cavity. The interposers are arranged in the second cavity, with the LEDs being arranged in the through holes to emit light into the first cavity and through the opening. Besides accommodating the interposers, the second cavity may also be used to accommodate other elements of the lighting device. In particular, the second cavity may effectively be used to improve heat conduction from the LEDs. A rear opening may be provided for the second cavity to insert elements of the lighting device into the second cavity or to fill the second cavity.

In an exemplary embodiment of the invention, the second cavity may at least partially be filled with a filler material. The filler material may also provide improved mechanical stability and protection from humidity. The filler material in the second cavity may for instance also provide improved heat conduction from the interposers and LEDs. As the second cavity is not required for the transmission of light and may be arranged on the side of the interposer facing away from the LED, the second cavity may at least partially filled with a reflective filler material. A reflective filler material, such as white silicone, may have significantly improved heat conductivity in comparison to transparent filler materials such as transparent silicone.

In an exemplary embodiment of the invention, the lighting device further comprises connection elements for an electrical connection between the interposers, wherein in particular the connection elements are arranged in the second cavity. As described above, each LED may in particular be provided with a separate interposer to allow flexibility properties of the lighting device. The connection elements may in this regard also be configured as flexible elements, e.g. as wires between the interposers. By arranging the connection elements in the second cavity, the connection elements may be embedded in a filler material for the second cavity, which may provide electrical insulation, heat conduction and protection for the connection elements.

In another exemplary embodiment of the invention, the lighting device further comprises an optical element that is arranged in the opening. The optical element may comprise diffractive and/or reflective elements. For example, the optical element may comprise at least one lens such as a TIR lens or Fresnel lens. The optical element has in particular the shape of a strip, such that the optical element can be produced and applied to the lighting device cost-effectively.

In an exemplary embodiment of the invention, the lighting device further comprises a diffusor strip arranged in the opening. With a diffusor strip, the light emitted by the LEDs and passing the opening can be scattered to obtain a softer illumination. As the diffusor has the shape of a strip, the diffusor can be easily produced and applied to the lighting device. In particular, the diffusor strip may comprise protrusions, for instance protrusions with the shape of a sphere section, wherein the positions of the protrusions along the length of the housing correspond to the positions of the LEDs.

As already mentioned above, in some embodiments of the invention, at least part of the housing is based on silicone. Silicone provides highly flexible properties to the housing and therefore to the lighting device, while elements made of silicone can be easily shaped by methods such as extrusion and/or molding. In particular, silicone may have transparent properties, and may therefore be used for parts of the housing that require a transmission of light such as the transparent filler material and/or the diffusor strip. Materials based on silicone may also have reflecting and/or opaque properties, for instance when particles are embedded in the silicone. For example, by using reflective particles such as TiOx particles in the silicone (such as "white silicone"), elements made of silicone having a very high reflectivity and highly flexible properties can be obtained. In addition, white silicone shows significantly improved thermal conductivity in comparison to transparent silicone. For example, the reflective walls, the reflection element and/or the filler material for the second cavity may comprise or consist of silicone with reflective particles such as TiOx particles.

In an exemplary embodiment of the invention, the housing is at least partially provided by extrusion of a profile. For example, a profile may be extruded to provide a housing comprising the reflective side walls. The profile may also comprise a rear wall on a side of the housing opposite to the side of the opening. The profile may in this sense represent a U-shape, with the reflection element in particular being configured as a separate element that is inserted into the U-shape with the interposers and the LEDs.

The profile may also comprise the reflection element. In an embodiment, the reflective side walls and the reflection element are therefore integrally formed with the extrusion. For instance, the profile may in this sense represent an H-shape.

In case the profile also comprises the reflection element, the profile may be punched and/or cut subsequent to and/or during extrusion to provide the through holes in the reflection element.

Elements of the lighting device according to the invention may also be formed by other methods, for example by molding and/or mold-filling. In an exemplary embodiment of the invention, the production of the lighting device further comprises filling the first cavity at least partially with a transparent filler material and/or filling a second cavity formed between the reflecting side walls and the reflection element at least partially with a reflective filler material. The filling of the first and/or second cavity may also be performed in line on a strip-shaped housing, enabling a particularly effective production of the lighting device.

In another embodiment, the production of the lighting device further comprises providing a diffusor strip in the opening by molding. The molding of the diffusor strip may also be performed in line on a strip-shaped housing.

In an exemplary embodiment of the invention, the lighting device according is used in automotive lighting, in particular as automotive interior light. With flexible properties of the lighting device, the lighting device may also be brought into different shapes to conform to the design requirements in automotive lighting.

The features and example embodiments of the invention described above may equally pertain to the different aspects according to the present invention. In particular, with the disclosure of features relating to the method according to first aspect, also corresponding features relating to a lighting device for production according to the second aspect and to the use according to the third aspect are disclosed.

It is to be understood that the presentation of embodiments of the invention in this section is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

BRIEF DESCRIPTION OF THE DRAWINGS

Examples of the invention will now be described in detail with reference to the accompanying drawing, in which.

DETAILED DESCRIPTION OF THE EMBODIMENTS

Figure 1A:
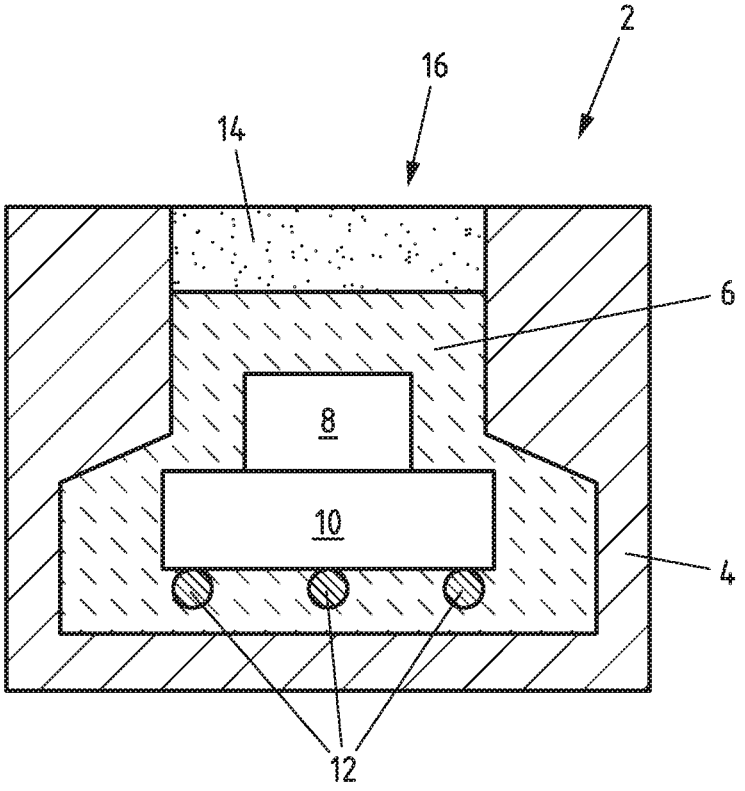
FIGS. 1A and 1B show a lighting device comprising an LED in a cross-sectional view.

In FIG. 1A, a lighting device 2 is shown in a cross-sectional view. A housing 4 comprises a cavity 6, in which an LED package 8 is arranged. The LED package 8 is disposed on an interposer 10 for electrical connection for providing electrical connection of the LED 8, wherein wires 12 are arranged in the cavity 6 to provide electrical power to the LED 8 by means of the interposer 10. The lighting device 2 further comprises a diffusor 14 arranged in an opening 16 of the cavity 6.

When the lighting device 2 is operated, the effectivity can in particular be enhanced by providing a housing 4 with reflective properties, such that the LED package 8 is practically surrounded by reflective elements (i.e. the LED package 8 is put into a "white box") except for the opening 16. However, part of the light emitted by the LED 8 and/or reflected in the cavity 6 is internally absorbed before the light can exit through the opening, e.g. by absorption on the interposer 10 or the wires 12, as light is travelling around and below the interposer 10.

Figure 1B:
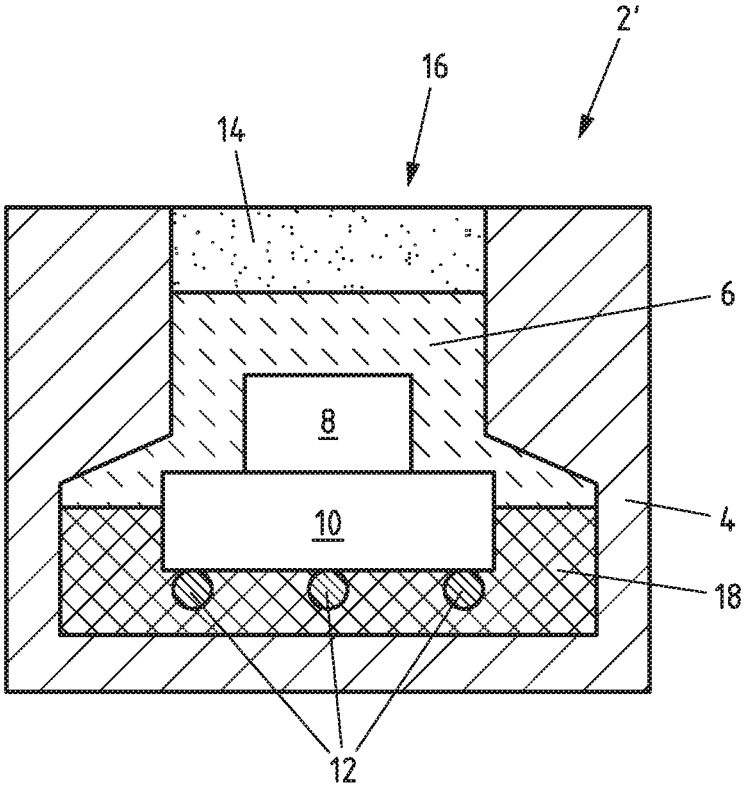

Therefore, as shown in FIG. 1B, part of the cavity 6 of the lighting device 2' may be filled with a reflective material 18, which may for example embed the wires 12 and part of the interposer 10. The filling of reflective material 18 therefore improves the efficiency of the lighting device 2'. However, with the filling of reflective material 18 as shown in FIG. 1B, the interposer 10 is not completely embedded in the reflective material 18, leaving parts of the interposer 10 exposed. When using more reflective material 18 for filling, the production of the lighting device 2' becomes difficult as it has to be avoided that reflective material 18 covers parts of the LED package 8, which would also lead to a loss in efficiency.

Figure 2:
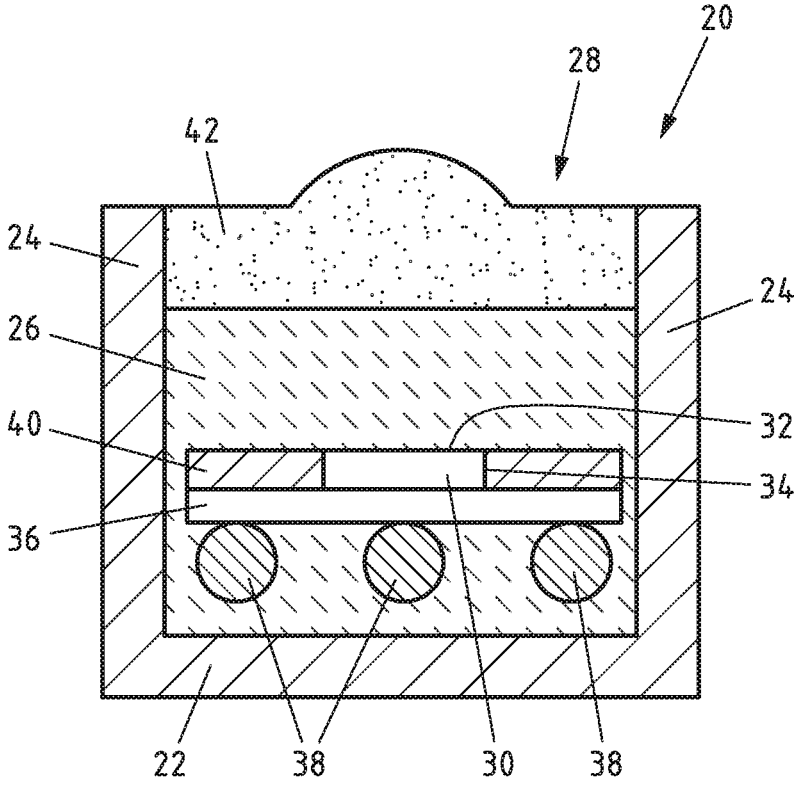
FIG. 2 shows an embodiment of a lighting device according to the invention in a cross-sectional view.

FIG. 2 shows an embodiment of a lighting device 20 according to the invention in a cross-sectional view. The lighting device comprises a housing 22 having a longitudinal direction, which runs perpendicular to the plane of view. The housing 22 is provided by extrusion of a profile has substantially the shape of a strip with a U-shaped cross section. The housing 22 comprises reflective side walls 24 extending in the longitudinal direction, a first cavity 26 disposed between the reflective side walls 24, and an opening 28 of the first cavity 26 for the passage of light from the first cavity 26. The housing 22 and in particular the reflective side walls 24 are based on "white" silicone with embedded reflective particles such as TiOx particles. The first cavity 26 is filled with a transparent filler material and in particular with transparent silicone.

LED packages 30 are provided, each LED package 30 having a light-emitting face 32 and side faces 34. The LED packages 30 are arranged on interposers 36 for providing electrical connection of the LED packages 30, wherein the LED packages 30 are mounted on a side opposite to the light-emitting face 32 to the interposers 36.

The LED packages 30 are arranged together with the interposers 36 in the first cavity 26. The LED packages 30 are arranged along the longitudinal direction of the housing 22 relative to each other. A plurality of LED packages 30 is provided, wherein each LED package 30 has a separate interposer 36, such that the lighting device 20 is flexible in between the interposers 36 and LED packages 30 due to the housing 22 being based on silicone. Connection elements 38 configured as wires are provided for an electrical connection between the interposers, wherein the wires also allow a flexing of the lighting device 20 in between the interposers 36. The LED packages 30, interposers 36, and connection elements 38 are embedded in the transparent filler material of the first cavity 26. Further, the LED packages 30 are surrounded by the housing 22 and in particular the reflective side walls 26, such that a large amount of the light emitted by the LED packages 30 is effectively reflected until the light exits through the opening 28. A diffusor strip 42 is arranged in the opening 28, wherein the diffusor strip 42 provides scattering of the light passing the opening 28, such that a softer illumination is obtained. The diffusor strip 42 comprises a protrusion shaped as a section of a circle in cross section.

The lighting device 20 further comprises a reflection element 40 that covers a side of the interposers 36 facing the opening 38 and that surrounds the LED packages 30 on the side faces 34. The reflection element 40 is configured as strip comprising through holes in which the LED packages 30 are arranged. Therefore, the reflection element 40 is particularly simple to produce, while the interposer 36 is effectively covered with a reflective material to avoid light loss by absorption. The reflection element 40 may be a strip with a thickness equal to or more than the thickness of the LED packages 32, such that the side faces 34 of the LED packages 30 are effectively covered and the LED packages 32 are embedded by the reflection element 40 on their side. By using the reflection element 40 configured as strip comprising through holes, an undesired covering or blocking of the light-emitting face 32 of the LED packages 30 can be avoided. Therefore, the light loss by internal absorption is reduced, increasing efficiency of the lighting device 20, while the lighting device 20 allows for a simple manufacturing process.

In the embodiment shown in FIG. 2, the reflection element 40 is configured as a cover strip with punched through holes for the LED packages 30 and as a separate element from the reflective side walls 24. For the production of the lighting device 20, the housing 22 may be provided by extrusion of a profile. The LED packages 30, interposers 36, connection elements 38, and the reflection element 40 may be inserted into the first cavity 26. The first cavity 26 may be filled with the transparent filler material and the diffusor strip 42 is molded into the opening 28.

Figure 3:
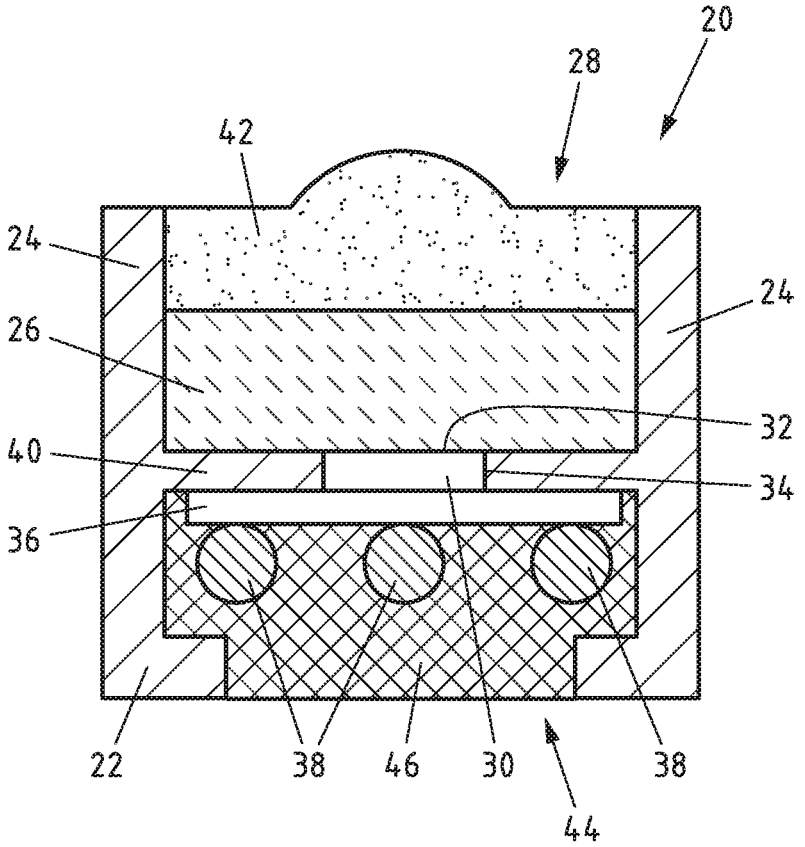
FIG. 3 shows an embodiment of a lighting device according to the invention in a cross-sectional view.

FIG. 3 shows another embodiment of a lighting device 20 according to the invention in a cross-sectional view, wherein corresponding elements have the same reference numerals as in FIG. 2. In contrast to the embodiment of FIG. 2, the reflection element 40 in FIG. 3 is formed integrally with the reflecting side walls 24. In particular, the housing 22 is provided by extrusion of a profile and based in silicone with embedded reflective particles, wherein the reflective side walls 24 and the reflection element 40 are formed together with the extrusion. In the extruded profile, through holes for the reflection element 40 may be formed by punching and/or cutting. The cross section of the housing 22 is substantially H-shaped with an opening 28 of the first cavity 26 for the passage of light from the first cavity 26. A rear opening 44 of a second cavity 46 is being formed between the reflecting side walls 24 and the reflection element 40.

For the production of the lighting device 20, after extrusion of the housing 22 and the introduction of the through holes in the integrated reflection element 40, the LED packages 30, interposers 36, and the connection elements 38 may be inserted into the second cavity 46 through the rear opening 44, such that the LED packages 36 are arranged in the through holes. The interposers 36 and the connection elements 38 are arranged in the second cavity 46. The first cavity 26 may be filled with a transparent filler material such as transparent silicone, with the diffusor strip 42 being molded into the opening 28. The second cavity 46 is filled with a reflective filler material, in particular silicone with embedded reflective particles, which improves the thermal conductivity from the LED packages 30.

Figure 4:
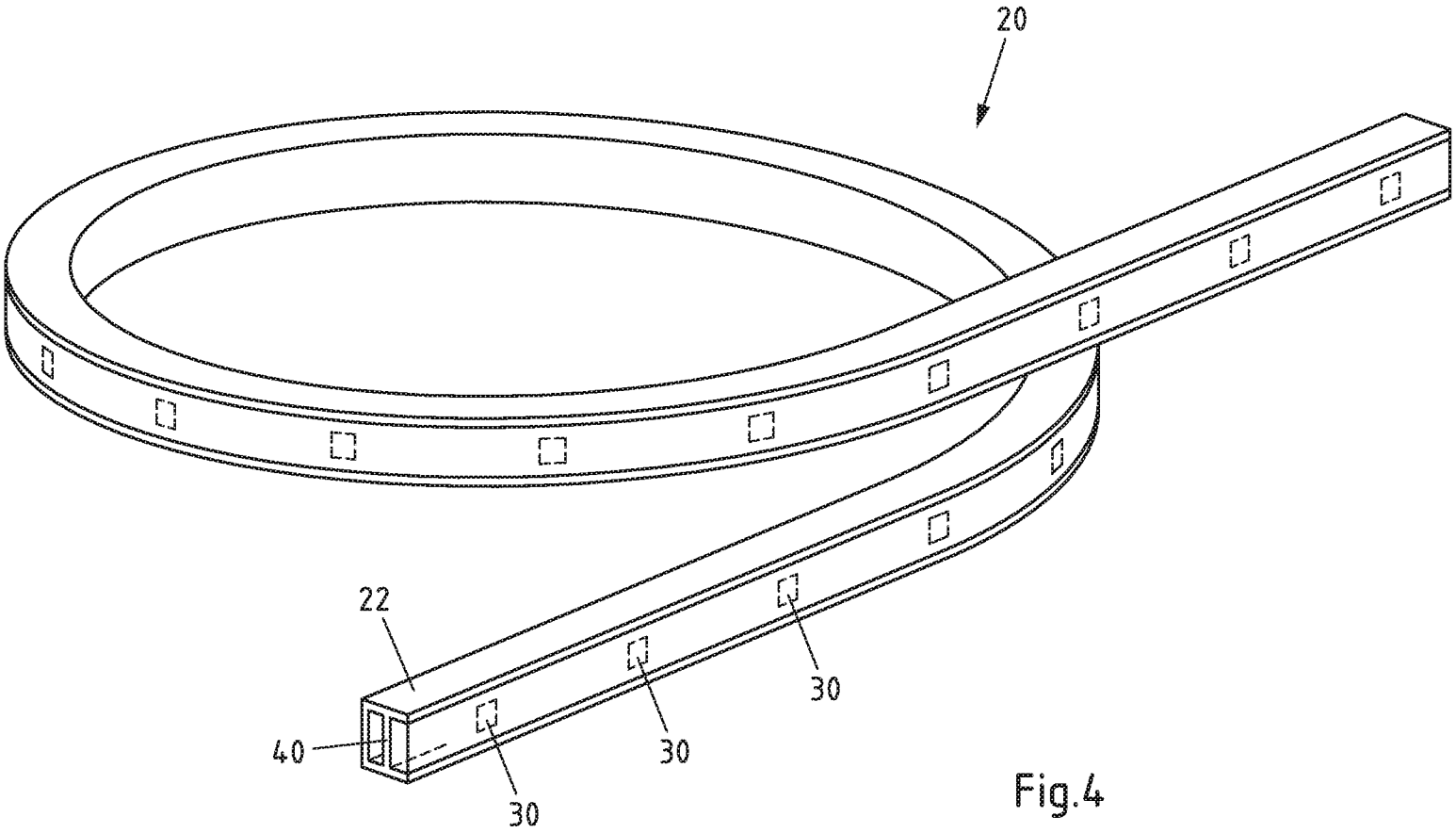
FIG. 4 shows an embodiment of a lighting device according to the invention in a schematic perspective view.

FIG. 4 shows an embodiment of a lighting device 20 according to the invention in a schematic perspective view. It can be seen that the LED packages 30 are arranged along the longitudinal direction of the housing 22. LED packages 30 and corresponding interposers 36 are spaced apart such that the lighting device 20 is configured as a flexible strip. In particular, the lighting device 20 may be used in automotive lighting such as automotive interior light, wherein the lighting device 20 can conform to various shapes due to its flexible properties.

What is claimed is:

1. A flexible lighting device, comprising:

a housing having a longitudinal direction, the housing comprising reflective side walls extending in the longitudinal direction, a first cavity between the reflective side walls, and an opening for the passage of light from the first cavity;

a plurality of separate interposers spaced apart from each other, each comprising at least one conductive connector;

a plurality of light emitting diodes (LEDs), at least partially arranged, relative to each other, along the longitudinal direction of the housing, each LED having a light-emitting face and side faces and disposed on a top surface of a respective one of the plurality of separate interposers;

a reflective strip completely covering a top surface of each of the plurality of separate interposers and comprising a plurality of through holes, one of the plurality of LEDs being arranged in each of the through holes, and a thickness of the reflective strip being equal to or greater than a thickness of the LEDs such that the reflective strip completely surrounds the side faces of each of the plurality of LEDs.

2. The flexible lighting device according to claim 1, wherein the reflective strip is formed integrally with the reflective side walls.

3. The flexible lighting device according to claim 1, wherein the reflective strip is configured as a cover strip with punched through holes for the LEDs.

4. The flexible lighting device according to claim 1, wherein the first cavity is at least partially filled with a transparent filler material.

5. The flexible lighting device according to claim 1, wherein a second cavity is formed between the reflective side walls and below the reflection element, wherein the interposers are arranged in the second cavity.

6. The flexible lighting device according to claim 5, wherein the housing has an H-shaped cross section.

7. The flexible lighting device according to claim 5, wherein the second cavity is at least partially filled with a reflective filler material.

8. The flexible lighting device according to claim 1, further comprising connection elements for an electrical connection between the separate interposers, wherein the connection elements are arranged in the second cavity.

9. The flexible lighting device according to claim 1, further comprising a diffusor strip arranged in the opening.

10. The flexible lighting device according to claim 1, wherein at least part of the housing comprises silicone.

11. The flexible lighting device according to claim 1 for use in automotive lighting.

12. The flexible lighting device according to claim 1, wherein at least one of the reflective side walls and the reflective strip comprises silicone with embedded reflective particles.

13. The flexible lighting device according to claim 12, wherein the silicone with the embedded reflective particles is a white silicone.

14. A method for producing a flexible lighting device, the method comprising:

providing a housing having a longitudinal direction, the housing comprising reflective side walls extending in the longitudinal direction, a first cavity between the reflective side walls, and an opening of the first cavity for the passage of light from the first cavity;

spacing apart a plurality of separate interposers, each of the plurality of separate interposers comprising at least one conductive connector;

providing LEDs, each LED having a light-emitting face and side faces;

arranging the LEDs in the first cavity with a respective one of the LEDs on a top surface of a respective one of the plurality of separate interposers such that the LEDs, relative to each other, are at least partially arranged along the longitudinal direction of the housing; and providing a reflective strip to completely cover a top surface of each of the plurality of separate interposers and comprising a plurality of through holes with one of the LEDs arranged in each of the through holes, and a thickness of the reflective strip being equal to or greater than a thickness of the LEDs, such that the reflective strip completely surrounds the side faces of each of the plurality of LEDs.

15. The method according to claim 14, wherein the housing is at least partially provided by extrusion of a profile.

16. The method according to claim 15, wherein the extrusion comprises integrally forming the reflective side walls and the reflective strip.

17. The method according to claim 14, further comprising at least one of filling the first cavity at least partially with a transparent filler material or filling a second cavity formed between the reflective side walls and the reflection element at least partially with a reflective filler material.

18. The method according to claim 14, further comprising providing a diffusor strip in the opening by molding.

* * * * *